United States Patent [19]

Whitney, Jr.

[11] 4,171,600

[45] Oct. 23, 1979

[54] PROCESS FOR CONSTRUCTING MODULAR BUILDING AND RESULTING PRODUCT

[76] Inventor: Clifford C. Whitney, Jr., 3620 Springbrook, Dallas, Tex. 75205

[21] Appl. No.: 800,531

[22] Filed: May 25, 1977

[51] Int. Cl.[2] ..... E04D 1/35; E04D 1/34

[52] U.S. Cl. ..... 52/745; 52/79.4; 52/81; 52/200; 52/219; 52/236.1

[58] Field of Search ..... 52/236.1, 79.6, 69, 52/79.4, 79.5, 81, 741, 745, 82, 71, 200, 218, 219, 116, 127

[56] References Cited

U.S. PATENT DOCUMENTS

| | | | |
|---|---|---|---|
| 1,924,480 | 8/1933 | Bayley | 52/236.1 X |
| 3,018,546 | 1/1962 | Dewese | 52/127 X |
| 3,068,534 | 12/1962 | Hu | 52/236.1 X |
| 3,295,265 | 1/1967 | Hida | 52/741 X |
| 3,531,845 | 10/1970 | Senftleben | 52/745 X |
| 3,546,831 | 12/1970 | Romo et al. | 52/83 X |
| 3,724,142 | 4/1973 | Worthington | 52/79.4 X |
| 3,774,356 | 11/1973 | Philp | 52/71 X |
| 3,780,639 | 12/1973 | Wood | 52/219 X |
| 3,807,101 | 4/1974 | Cole | 52/236.1 |
| 3,832,811 | 9/1974 | Briel, Jr. | 52/79.5 X |
| 3,872,631 | 3/1975 | Nowell | 52/67 |
| 3,921,354 | 11/1975 | Connelly et al. | 52/236.1 |
| 3,953,947 | 5/1976 | Hendrich | 52/71 X |
| 4,015,381 | 4/1977 | Schmidt | 52/219 X |
| 4,050,214 | 9/1977 | Johnson | 53/745 |

FOREIGN PATENT DOCUMENTS

| | | | |
|---|---|---|---|
| 2549938 | 5/1977 | Fed. Rep. of Germany | 52/69 |
| 1554904 | 12/1968 | France | 52/69 |

*Primary Examiner*—Leslie Braun

[57] ABSTRACT

This economical construction process utilizes preconstructed and modular techniques to erect single and multiple commercial, industrial and residential units what may be required to be built in urban or remote areas with a minimum of erection labor. The resulting product includes a pyramid-like section suspended from a centrally located chimney that also serves as a structural element both during construction and thereafter. Another embodiment uses a structural truss in lieu of the chimney for final support purposes.

1 Claim, 32 Drawing Figures

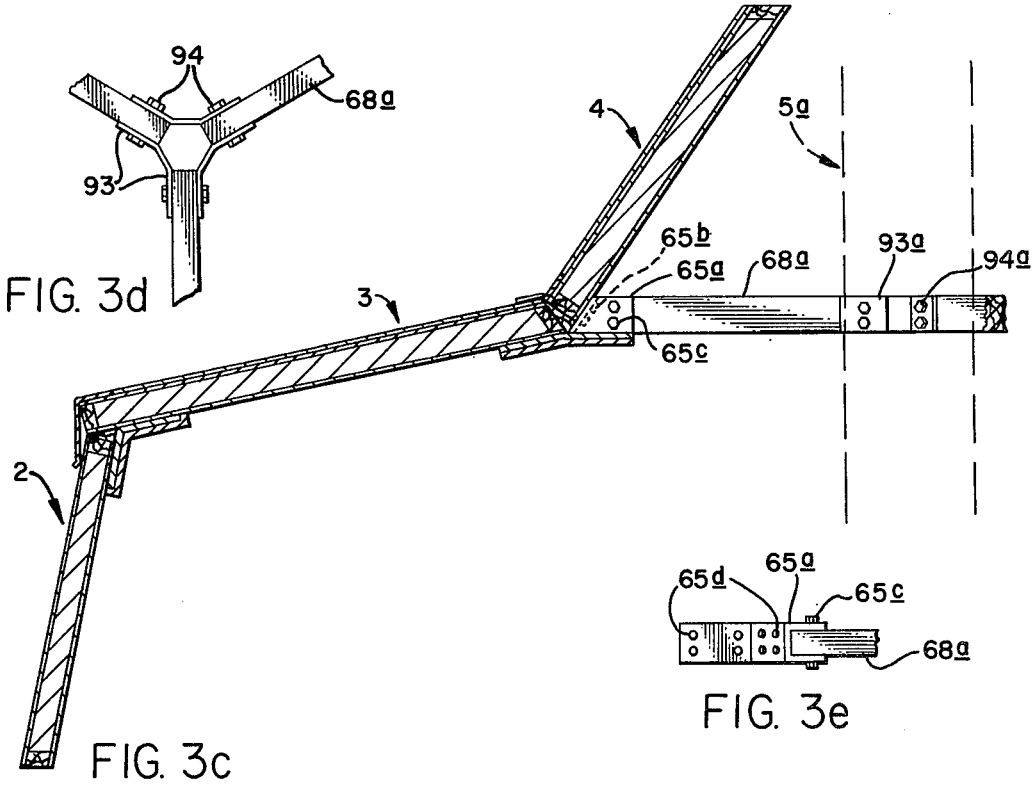
FIG. 3d
FIG. 3e
FIG. 3c
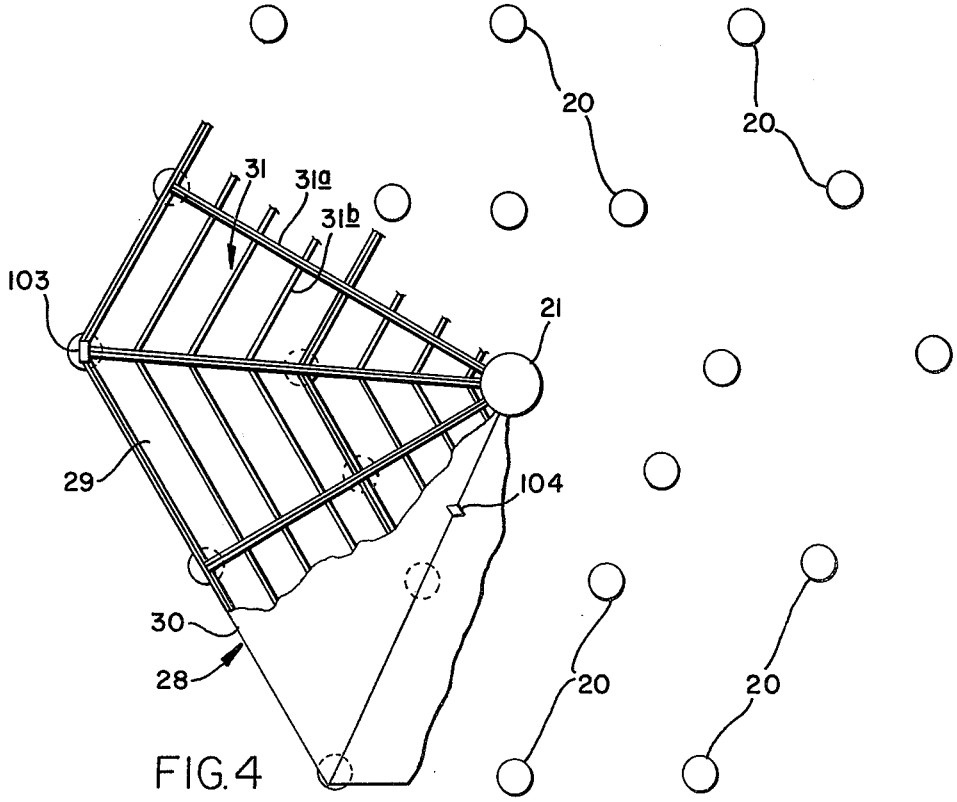
FIG. 4

PROCESS FOR CONSTRUCTING MODULAR BUILDING AND RESULTING PRODUCT

This invention was filed under the Document Disclosure Program as Disclosure Document No. 058,326 on Feb. 28, 1977, and said Document is incorporated herein by reference.

BACKGROUND OF THE INVENTION (1) Field of Invention

This invention relates to the field of building construction, processes employed therein, and the resulting products.

(2) Description of the Prior Art

There have been many patents issued in areas of prefabrication of parts and erection of the parts into a complete building at a location separate from the location where the parts are fabricated. However, there are relatively few patents that cover buildings erected at the site of their permanent location by employing the technique of utilizing a central member from which all wall and roof sections are raised into place. This is particularly true where the central member remains a functional element of the building.

The patents listed below seem pertinent to this art:

U.S. Pat. No. 3,295,265 to Hida discloses a prefabricated building that is manually assembled from small sections and panels that can be erected and installed without the use of an erection tool of any kind. Hida has a center member of the same height as the side panels and which member acts as a hub from which spoke-like beams radiate outward to engage and secure individual small side panels. Hida does not employ large, heavy side and roof panels, so he does not need the centerpole lifting crane as shown by the Applicant.

U.S. Pat. No. 3,724,142 to Worthington discloses a plurality of prefabricated modular units that are assembled to join a central room. His construction likewise does not employ a centrally located crane or lifting unit as required by the Applicant.

U.S. Pat. No. 3,546,831 to Romo does employ a centrally located boom to lift his roof structure each time a series of wall panels are installed. When his building is completed, the central boom, which is attached to an erection vehicle, is telescoped to a smaller size and folded about the rear axle of the erection vehicle and removed from the building. Applicant's central erection crane or gin pole is attached to and operated from a centrally located chimney that remains as a permanent part of the finished building in one embodiment.

U.S. Pat. No. 3,943,671 to Curci discloses a pre-built housing structure supported above the ground in a cradle-like support. This unit does not utilize the central erection means necessary in the Applicant's structure and method.

U.S. Pat. No. 3,872,631 to Nowell utilizes a pair of overhanging support means to assist in removing one structure telescoped within another.

U.S. Pat. No. 3,791,093 to Finsterwalder utilizes a central column of concrete in the shape of a silo to support ceilings and room sections that surround the center silo when this multistory building is completed to provide a suspended building of a generally egg shape.

The Applicant's initially intended single family dwelling differs markedly from the preceding prior art examples of building constructions both in the total resultant building and in its complete method of construction. None of the prior art disclosures accomplish the Applicant's purpose in the manner or with the structure of the present invention as it directly relates to the construction field.

SUMMARY OF THE INVENTION

A primary object of this invention is to provide a simple, easy to use, economical method of constructing a panelized/modular building.

Another object is to provide a repeatable construction process by which a very few men with one truck can erect the panelized/modular building of this invention once the building sections are delivered to the site.

A further object is to provide a building erection process whereby the external walls and roof of the building of this invention can be erected in place on the building site in one day so that an overnight change in weather, as is common in remote mountainous regions, will not damage the building interior, or delay completion of the construction.

And, another object is to provide a modular building that comprises an attractive non-regular hexagonal plan shape having relatively long wall sides and relatively short door or window sides.

An additional object is to provide a structural building shape that attractively blends a pyramidal roof shape into a hexagonal plan shape.

And yet another object is to provide a modular building system that includes at least the following features:

a. Ease of manufacture in a plant facility.

b. Simple structural concept that can be tooled for labor saving fabrication.

c. Proven materials and engineering designs that preclude the requirement of extensive field testing before acceptance.

d. Ease of transportation of building sections to the building site and ease of handling thereat.

e. Elimination of the requirement of expensive, heavy-duty erection equipment.

f. Employs light weight but structurally sturdy building sections with good insulating properties.

g. Provides security against vandals and the like.

h. Provides protection of vertical glass areas against storms and high winds.

i. Provides a support system that permits multiplicity of interior arrangements.

j. Provides a structure that can be erected on a variety of foundation systems and can be lifted onto brackets for a high rise multiple use building.

k. The accomplishment of the above features with economy of both materials and labor.

BRIEF DESCRIPTION OF THE DRAWINGS

FIG. 3*c* is a modified embodiment of the interior support of FIG. 3*b;*

FIG. 3*d* is a detail plan view of the interior support center attachment;

FIG. 3*e* is a plan view of the beam to roof attaching channel gusset of FIG. 3*c;*

FIG. 4 is a plan view of the building site when concrete piers are used as the foundation;

DESCRIPTION OF THE PREFERRED EMBODIMENTS

The total concept of this invention provides an economical and attractive multiple purpose building or family dwelling that meets the desirable criteria of an extremely attractive, yet unconventional appearance without deviating from proven engineering principles of construction and yet adaptable for use with innovative concepts such as solar heating, and complete fire protection systems, and one that must be economically competitive with other available building structures.

Figure 1:
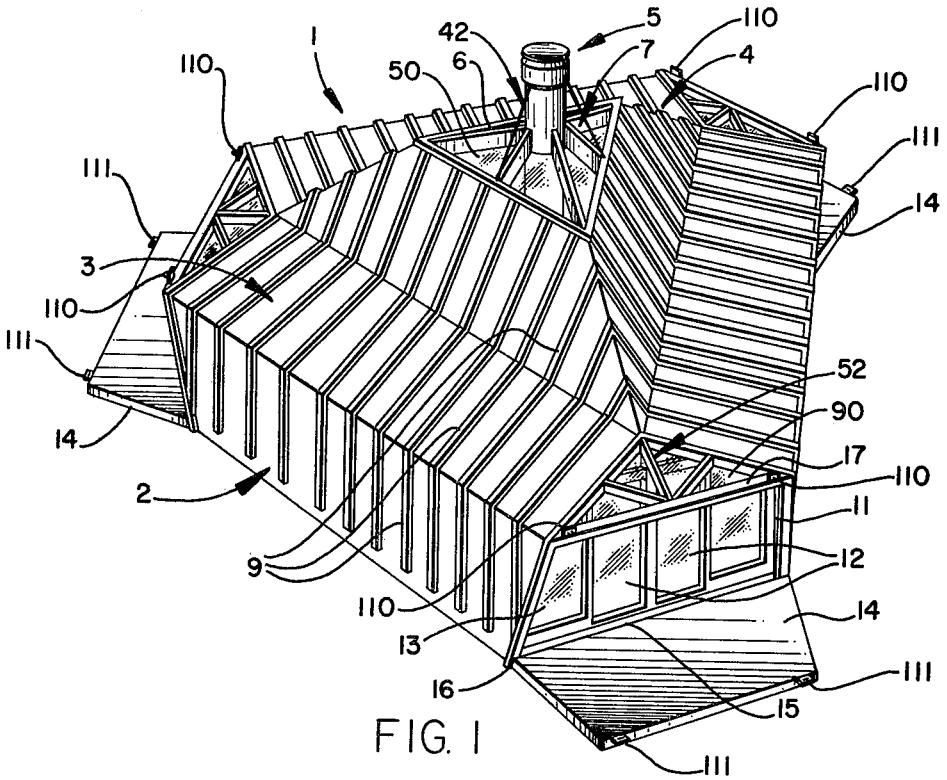
FIG. 1 is a perspective view taken above the modular building of this invention.

The completed dwelling or structure shown at 1 in FIG. 1 is seen to provide a compact modular unit that is exceedingly attractive in appearance and will be shown to be structurally sound, easy to construct, and economical in cost. Dwelling or structure 1 is hexagonal in plan, includes slightly inwardly sloping side walls 2 as they approach the shortened roof section 3, which slants downward from its joinder with the pyramidal roof section 4 to its connection with side walls 2. A central member 5 serves as both the chimney and central support for dwelling 1. Pyramidal roof section 4 terminates in a central triangular opening 6 that surrounds chimney 5. Three support cables or chains 42 engage the column 5 to provide the vertical support for the roof panels and will provide a stout, rigid structure, which by combining with the side walls 2 braces the roof 3, 4 against wind loads from any direction. Three solid beams 68*a* tie the juncture of panels 3 and 4 (FIG. 3*b*) to the chimney 5 thru insulated connectors 68*b* and provide lateral stability against wind forces. The center opening 6 provides a skylight for the interior 8 of dwelling 1, and may be glazed with clear or cloudy glass or plexiglass as desired to keep out moisture and outside air. It will be noted that side walls 2, the outer roof section 3, and the inner roof section 4 all include a bracing taper or slope. When these members are tied into the central support chimney they provide a combination of maximum support with minimum parts in a dwelling of this type. Battens 9 are representative of a sheet metal/batten roof system. Other materials such as fiberglass, wood shingles, asphalt shingles can also be used with equal structural and esthetic integrity.

Figure 2:
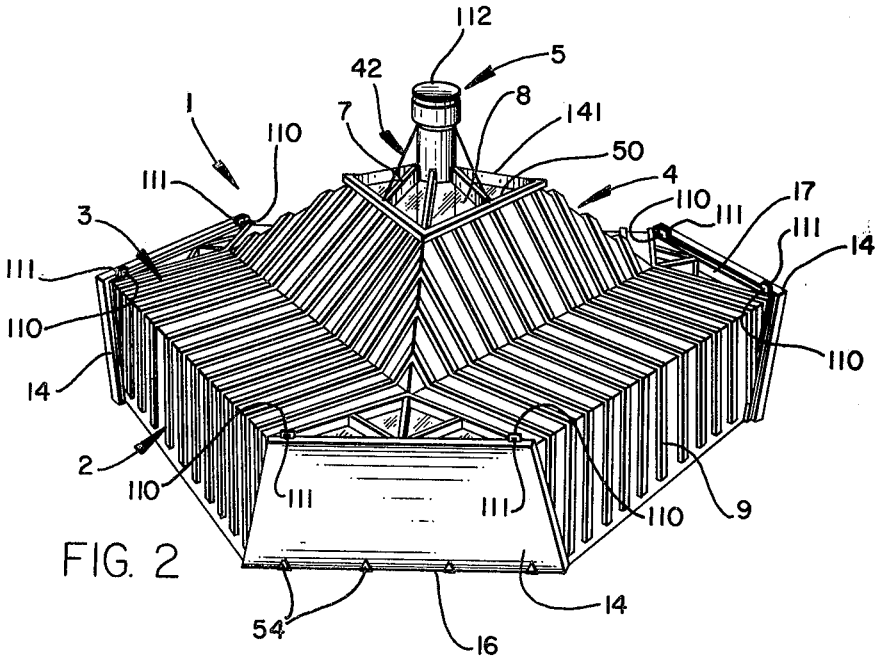
FIG. 2 is a view similar to that of FIG. 1, wherein the building porches are shown in their security mode.
Figure 19:
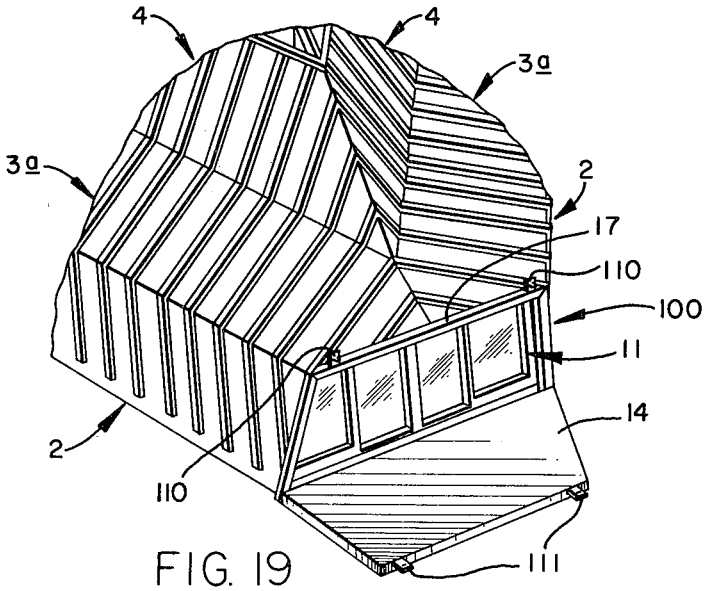
FIG. 19 is a fragmentary perspective view of an optional form of roof section to eliminate the open area above the doors.

Between each of the side wall sections 2, there are located glassed panels 11 that may include glass doors 12 and/or glass windows 13. Extending outward from each glass panel area 11 there is a flat porch section 14 that provides easy access to the doors 12 when in the position shown in FIG. 1. However, porch sections 14 are hinged to floor 15 at 16 so that the porch 14 may be folded upward about hinges 54 until it engages cross bar 17 that joins adjacent roof sections 3 at their intersection with wall panels 2. Upon engagement, the porch 14 may be securely locked to bar 17 so that the entrance to dwelling 1 is effectively secured against unwelcome intruders. This secured mode is shown in FIG. 2. In addition to securing the interior of the dwelling against intrusion, another function of the folding porch section 14 is that when the owner is away the glass panels 11 are protected against high wind damage the occurs in locations subject to heavy storms or hurricanes. By extending the roof panels 3, the open area 90 above the doors may be closed in completely to provide further security, as shown in FIG. 19.

Figure 3A:
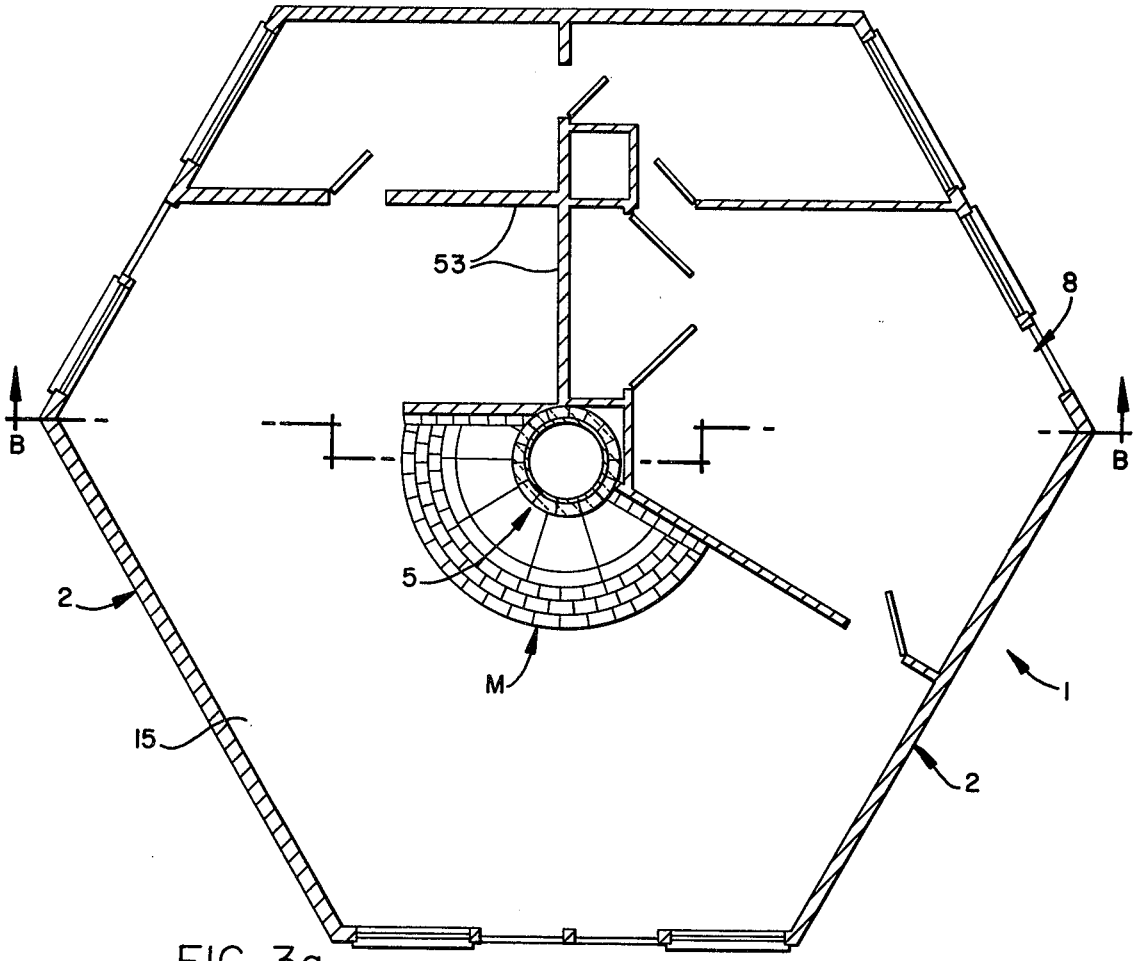
FIG. 3*a* is a cross-sectional plan view of the building of FIG. 1 showing a typical floor plan of the interior of the building.

The interior 8 of dwelling 1 is seen in the sectional views of FIG. 3 to provide an extremely large, roomy interior occupant space with a minimum of structural encumbrances. The living area surrounds the centrally located fireplace M and chimney 5 and extends radially to the side walls 2 with no support columns to detract from its appearance and magnitude. The interior may be further examined with reference to FIG. 3*a*, which shows one embodiment of a floor plan to segregate the several rooms for family use.

FIG. 3*c* shows two alternate embodiments of the support structure and connectors that may be employed when the central chimney support is not present or when column 5*a* is in place as the central support. After the exterior construction is completed and column 5*a* is removed, the solid beams 68*a* are attached to joinder area of roof panels 3 and 4 thru channel gussets 65*a* by bolts 65*b* (via bolt holes 65*d*) and to gusset plates 65*a* thru bolts 65*c*. The three solid beams 68*a* are joined together in the center of the interior of the building by bolts 94*a* thru gusset plates 93*a* that surround the center column 5*a*. FIG. 3*d* shows a similar construction for attaching the inboard ends of solid beams 68*a* thru gusset plates 93 and lag screws 94, after column 5*a* is removed, and in its absence. In many instances gussets 93 and 93*a* may be identical.

Figure 5B:
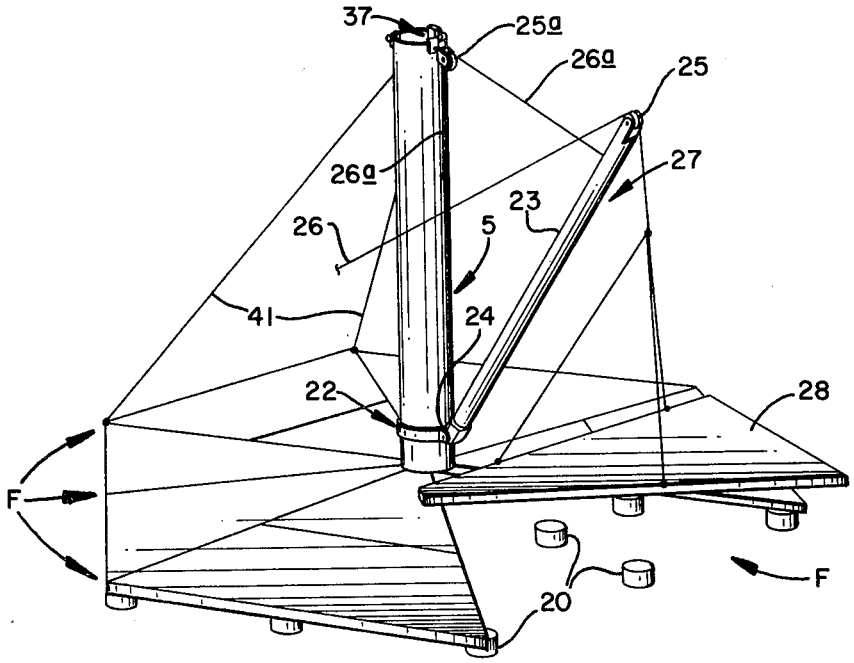
FIG. 5*b* is a perspective view of the building site of FIG. 4 showing a portion of the floor being installed.
Figure 5A:
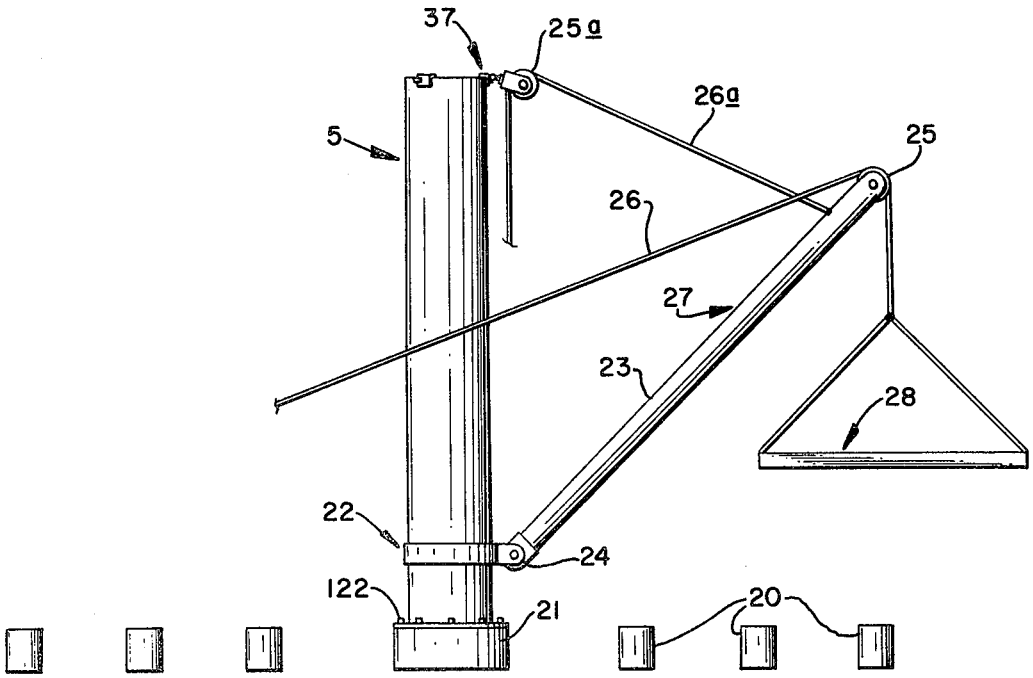
FIG. 5*a* is an elevational view of the erection equipment, typical floor sections and foundation piers of FIG. 4.
Figure 6:
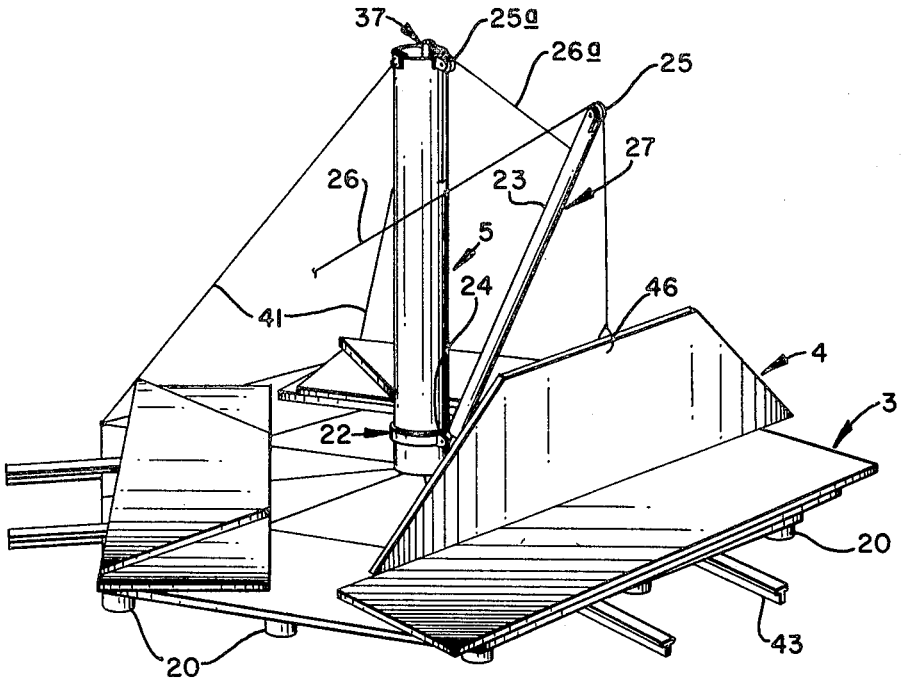
FIG. 6 is a view similar to FIG. 5*b* but wherein the wall/roof panels have been placed on the completed floor area in readiness for installation.
Figure 7:
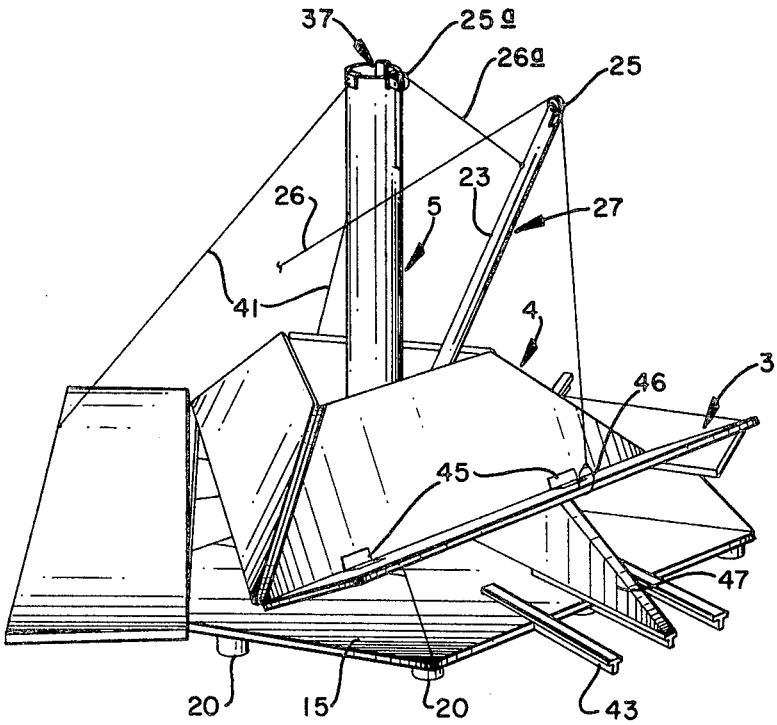
FIG. 7 is a view similar to FIG. 6 wherein additional steps have been taken in the erection of the wall and roof panels.
Figure 8:
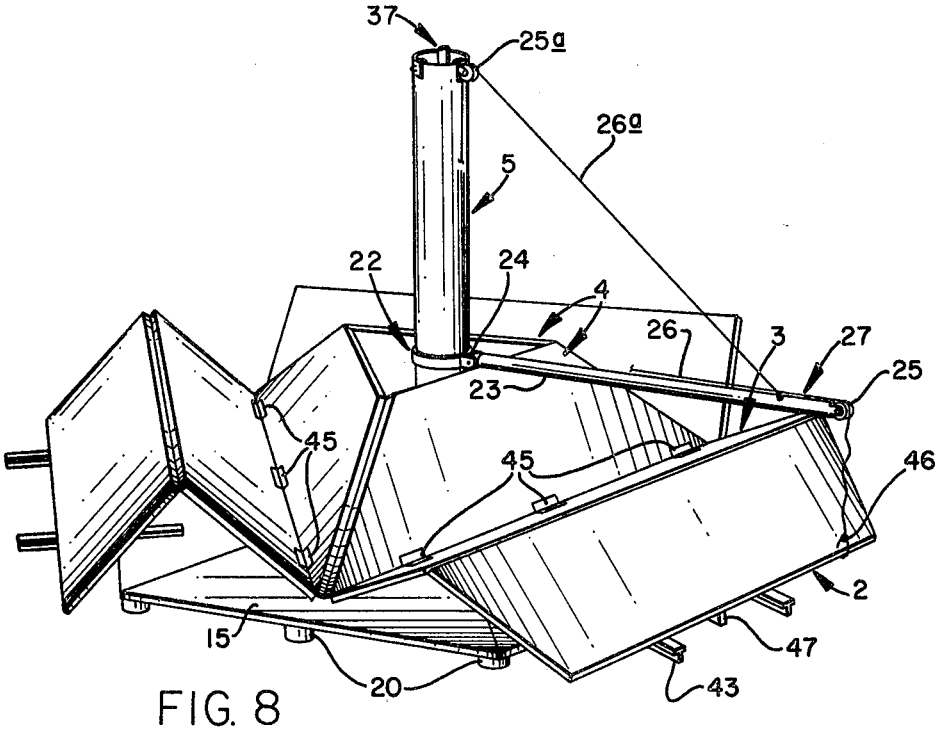
FIG. 8 is a view similar to FIG. 7, after the wall/roof panels have been attached in preparation for raising into final position.
Figure 14:
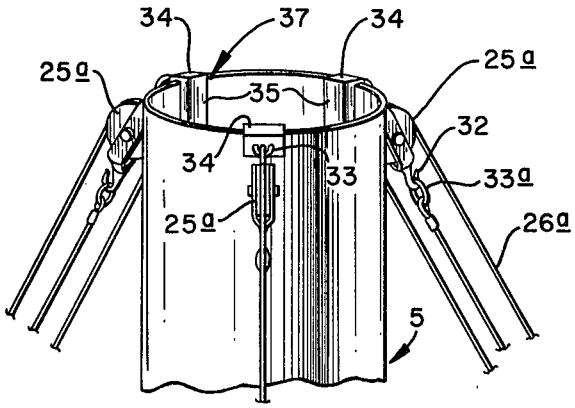
FIG. 14 is a perspective view of the open top of the central support column with the construction saddle bracket in place.
Figure 16:
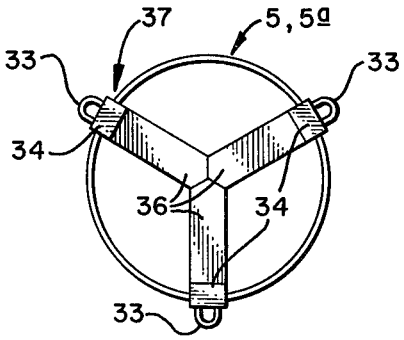
FIG. 16 is a top plan view looking into the open top column of FIG. 14.
Figure 17:
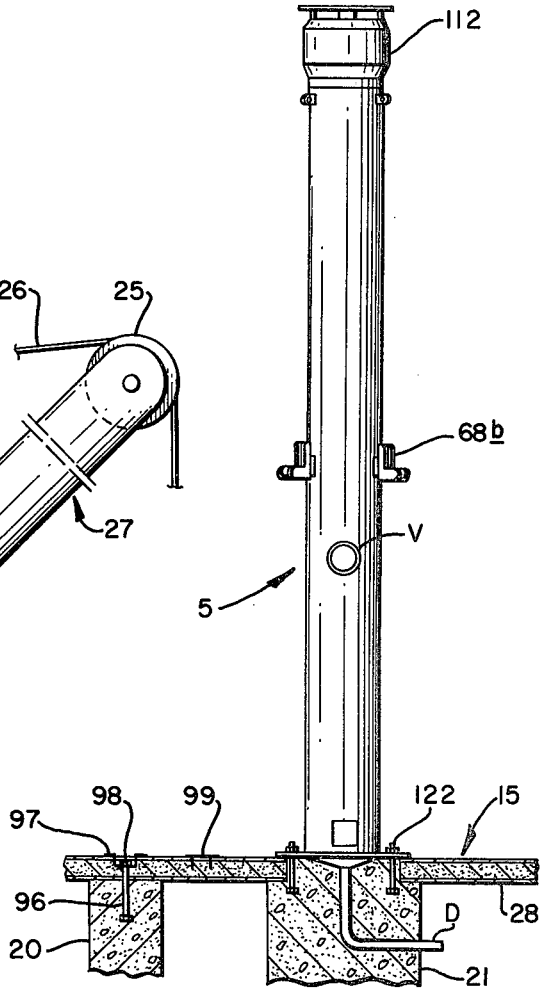
FIG. 17 is an elevational view, partly in section, showing one embodiment of the central chimney and foundation construction.

The unique method of this invention combines several known techniques into simple, easy to follow, steps of erecting and constructing a building unit from the ground up with a minimum of labor and equipment. FIG. 4 shows the building site onto which foundation piers 20 have been installed and onto which the chimney foundation 21 has been poured. This is the first step in this erection method after the building site has been selected and cleared and the foundation is now ready to receive typical panel arrangements to provide the flooring. The next step is construction of the chimney 5 onto its foundation 21, as shown in FIG. 5*a* (also see FIG. 17), and at this point the chimney includes a lower gin pole and pulley support strap 22. When gin pole boom 23 is pivoted at 24 to support strap 22 surrounding chimney 5 and pulleys 25, 25*a* and cables 26, 26*a* are installed, the resulting combination functions as a lifting crane, identified as 27, to reach out onto the surrounding ground or truck and pick up an individual floor panel section 28 and move it into place over certain of the piers 20. The pulleys in the diagrammatic construction views of FIGS. 5–10 are shown to be single sheave for simplicity of presentation, whereas they are actually parts of block and tackle systems shown in more detail in FIGS. 14–16. The top pulleys 25*a* may be supported by saddle bracket 37 (see FIGS. 14–16). The operator then rotates the crane 27 to align with another floor section area F and so on until all of the floor section areas F have been completed and all panels 28 have been moved into place over the piers 20 and secured there to and to each other. Panels 28 are anchored to piers 20 by studs embedded in the piers when cast. These threaded studs 96 align with the space between adjacent panels and are engaged by recessed plates 97 that receive nuts 98 that bind plates 97 to both adjacent panels, as shown in FIG. 17. Panels 28 may also be joined together by thin flat gussets 99 having pointed tips that are pressed into adjacent panels. The individual floor panel sections 28 are made of stressed skin construction as seen in FIG. 4. This construction utilizes an exterior grade plywood sheet 29 on the bottom side of the panel 28 and an interior grade plywood sheet 30 on the top side of the panel and wherein the interior between these two sheets comprises a structural frame 31 made up of 2"×6" or comparable joists 31*a* and spacers 31*b* to which the sheets are nailed and glued in accordance with the American Plywood Association (APA) specifications. Fireproof insulation will be inserted in all open interior space between joists and elsewhere in this construction.

Figure 15:
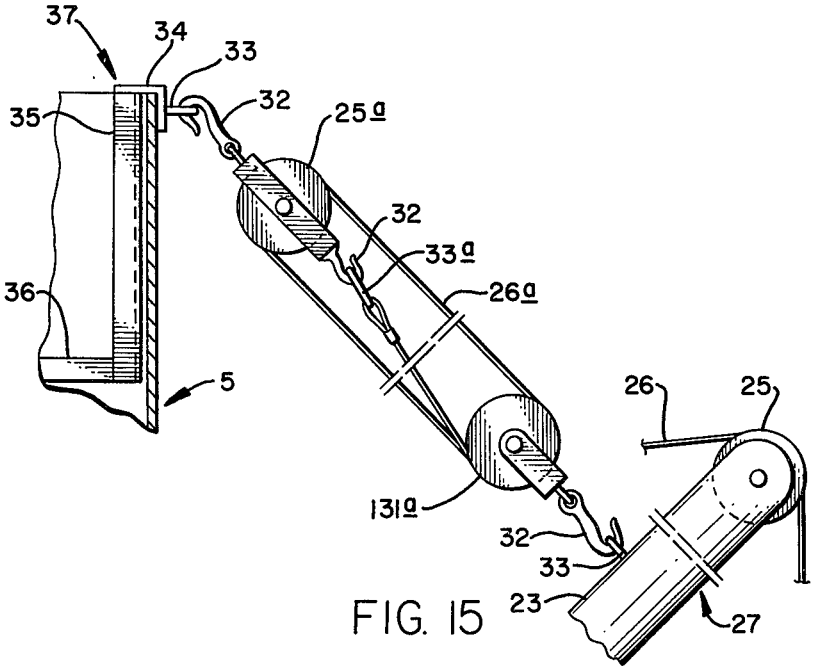
FIG. 15 is a side elevational view of one element of the three element bracket of FIG. 14.

The rigging of cable 26*a*, as shown in FIG. 15, between multi-sheave pulleys 25*a* and 131*a* is such that the lifting force required for a relatively heavy floor panel can be reduced to a force which can easily be handled by a truck winch, capstan attached to a truck axel, or can also be handled by construction workers, if necessary. Similarly, the rigging of cable system 26 can be arranged between multi-sheave pulleys 25 and 131 (not shown) to produce a similar reduction in force required.

The pulleys 25, 25*a*, 131 (not shown) and 131*a*, include a hook structures 32 to attach the pulleys to eyes 33 of angle 34, and cable rings 33*a*, or directly to the roof load during final erection. Angle 34 is attached to channel 35 which attaches to channel 36. Members 33–36 comprising construction saddle bracket 37 which slips down into the open top of chimney 5 or support column 5*a*, then becomes the focal point for the lifting and installational operations. The inner ends of channels 36 meet in the center of the top opening of chimney 5 or column 5*a*, and are shaped and welded together to provide a sturdy structure, yet one which may be rotated manually around the upper edge of the opening in 5 or 5*a* to follow the desired location of the gin pole boom 23. The cables and angles 34 not being used in the crane operation provide back support thru anchor cables 41 during the lifting operations.

Design patent applications, Ser. Nos. 727,892, filed Nov. 1, 1976, and 757,318, filed Jan. 6, 1977, of the inventor, are incorporated herein by reference. These applications show both stackable and clusterable arrangements of the modular building of this invention. The methods of constructing both the individual and multiple structures in those applications are described herein.

The modular building of this invention is particularly adapted to be fabricated of engineering proven but light weight materials, such as stressed skin panels (e.g. 28), which comprise an outer sheet of exterior plywood and an inner sheet of interior plywood (or sheet rock on walls and roof) spaced from the outer sheet by a series of generally parallel beams nailed and/or glued to the plywood sheets. This type of panel may be used selectively for wall, roof or floor member panels. Another construction that may be used is a sandwich panel that is made up of layers of light weight material glued to each other and forming a panel of the desired thickness. Other materials utilized in this construction and necessary equipment not described herein are conventional and available on the open market. The entire construction method and structure is directed toward producing a building having a minimum of heat and energy loss and operating with minimum energy requirements, utilizing solor energy and wood fuel and having a minimum effect on the local environment and ecology. Solar absorption cells may be readily installed on both roof sections 3 and 4, by way of example, and flue gases are condensed and drained to an isolated disposal (not shown).

Figure 11A:
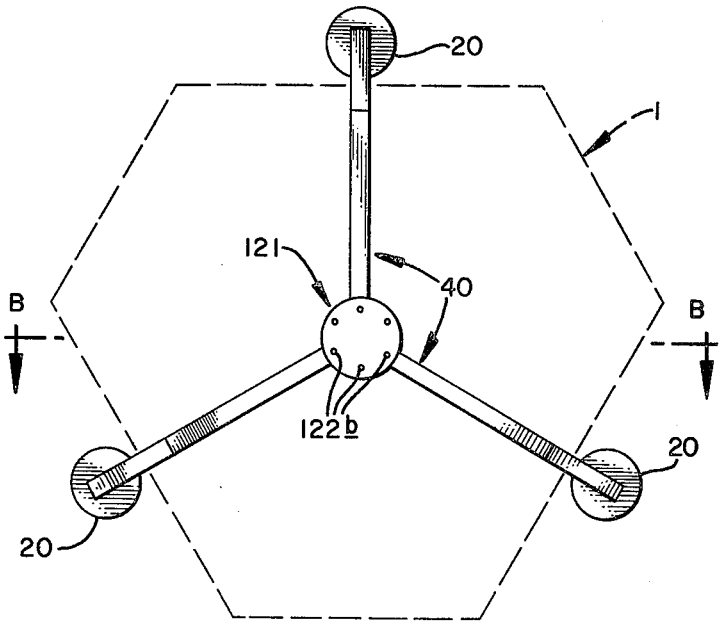
FIG. 11*a* is a top plan view of the truss foundation embodiment.
Figure 11B:
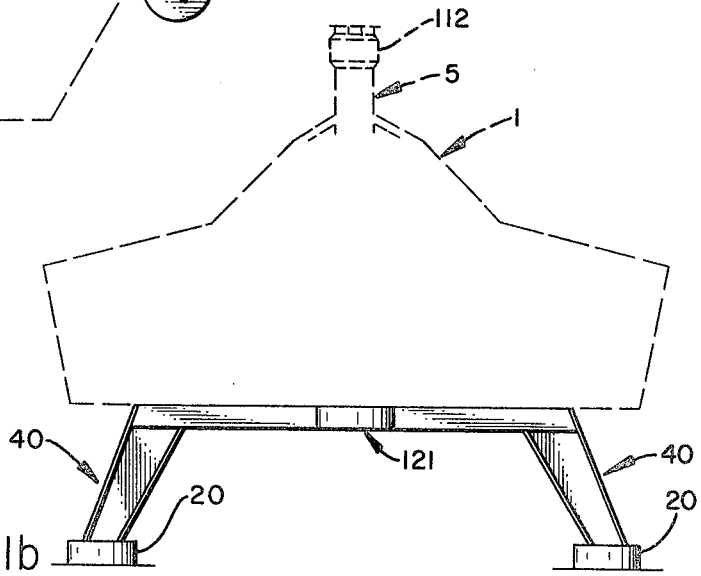
FIG. 11*b* is an elevational sectional view of the foundation of FIG. 11*a* taken along the lines B—B in conventional manner.
Figure 12:
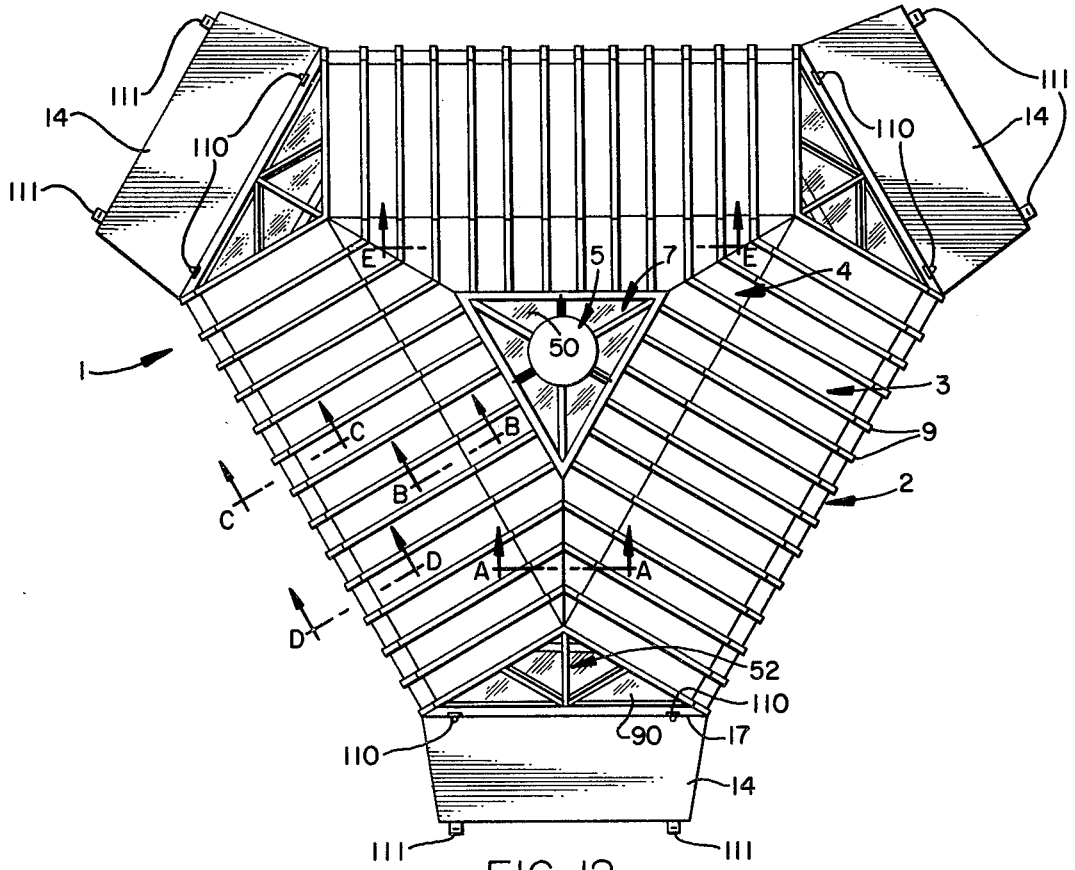
FIG. 12 is a top plan view of modular building of FIG. 1.
Figure 12A:
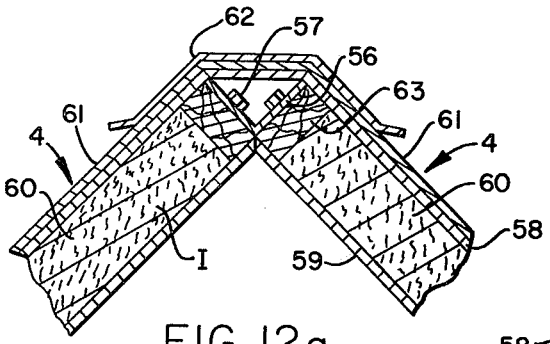
FIG. 12*a* is a fragmentary cross-sectional elevational view taken along the lines A—A of FIG. 12.
Figure 12B:
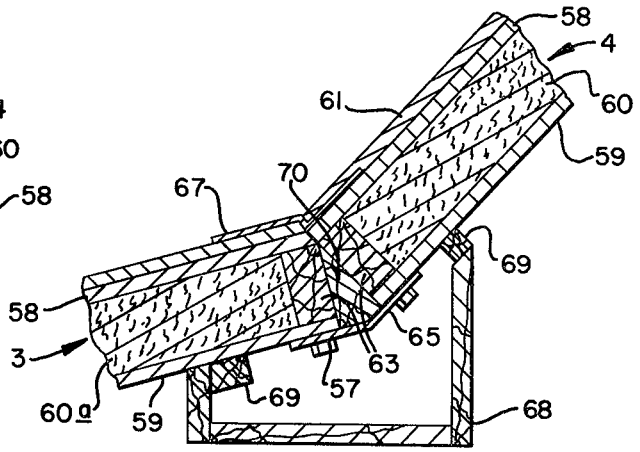
FIG. 12*b* is a fragmentary cross-sectional elevational view taken along the lines B—B of FIG. 12.
Figure 12C:
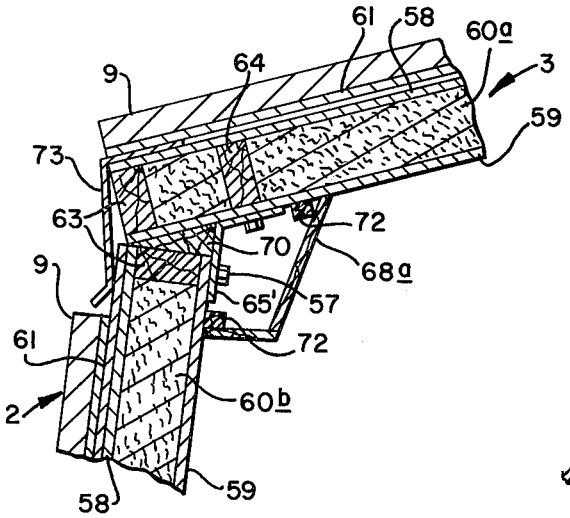
FIG. 12*c* is a fragmentary cross-sectional elevational view taken along the lines C—C of FIG. 12.
Figure 12E:
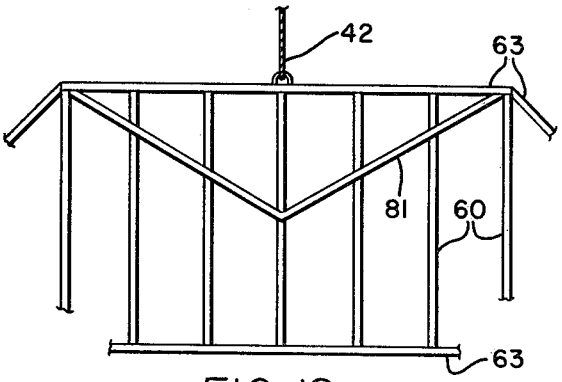
FIG. 12*e* is a fragmentary cross-sectional elevational view taken along the lines E—E of FIG. 12.
Figure 12D:
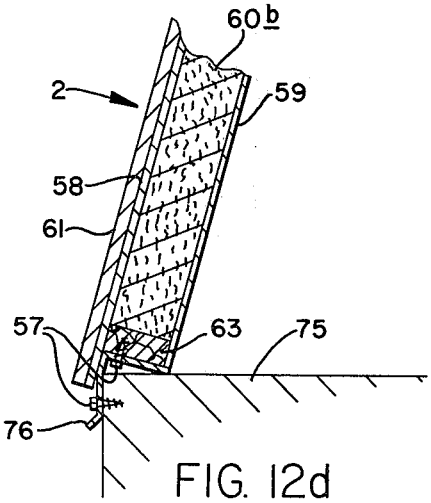
FIG. 12*d* is a fragmentary cross-sectional elevational view taken along the lines D—D of FIG. 12.

It will be observed in FIGS. 1–4, that the modular building 1 of this invention comprises a floor 15 individual panels 28 of which are installed on a series of piers 20 (FIG. 4), or alternatively on an elevated truss structure 40 (FIGS. 11*a*, 11*b*) or on a concrete slab 75 of FIG. 12*d*. Side walls 2 are attached to and arise vertically from the floor 15 or foundation 75 and join outer or lower roof sections 3 which join inner or upper roof sections 4 which are substantially self-supporting by innerconnecting with other inner roof sections. The upper edges 141 of inner roof sections 4 are supported by a chain or cable 42 that attaches to the chimney 5.

Referring now to FIGS. 5–10, the method of assembling some embodiments of this invention may be observed. FIGS. 5*a* and 17 show the installation by bolting onto pier 21 of a chimney 5 which is to act as the support of a gin pole crane arrangement identified generally as 27. The topper hood 112 of chimney 5 is removed during the erection process.

The method then basically comprises:

1. (FIGS. 5*a* and 5*b*) Lifting and maneuvering by cable systems 26 and 26*a* of crane 27, each floor panel 28 to its proper location in the floor area F on piers 20 until a complete floor 15 is obtained. The individual panels are bolted (thru cast in place bolts or studs 96, recessed plates 97 and nuts 98) or otherwise attached to piers 20 selectively or totally, and are bolted or otherwise attached to each other (as by spiked gussets 99) so that a stable base is obtained for subsequent operations, as seen in FIGS. 4 and 17.

2. (FIG. 6) Installing outriggers 43 onto the completed floor 15, and laying upper (4) and lower (3) roof sections on the outriggers and lifting the upper roof sections 4 into position for attaching construction hinges between sections 3 and 4.

3. (FIG. 7) Temporarily attaching hinges 45 between sections 3 and 4. Moving cable attaching clamp 46 from section 4 to section 3 and lifting section 3 until it forms an acute angle with floor 15 and inserting template 47 into this angle to position roof section 3 at the proper relative position for its attachment to side panel 2.

Figure 20:
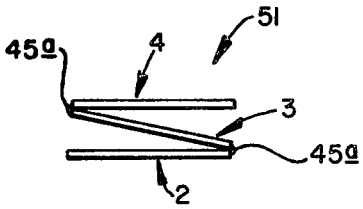
FIG. 20 is an end view of a modified construction of the wall panel and the two roof panels hinged for easy storage, shipment and erection purposes.

4. (FIG. 8) Lifting wall panels 2 in place on the templates 47 and permanently attaching brackets 65′ (not shown in FIG. 8) to the undersides of panels 2 and 3 and disconnecting the cable clamps 46. Attaching all adjacent panels 4 together, as described hereinafter. The modified preassembled construction 51 shown in FIG. 20 may be used to facilitate handling of panels 2, 3 and 4.

Figure 9A:
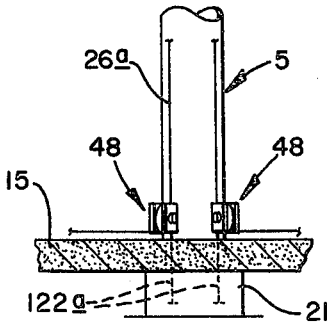
FIG. 9*a* is a fragmentary detail elevational view of the central column showing the snatch block pulleys used in FIG. 9.
Figure 9:
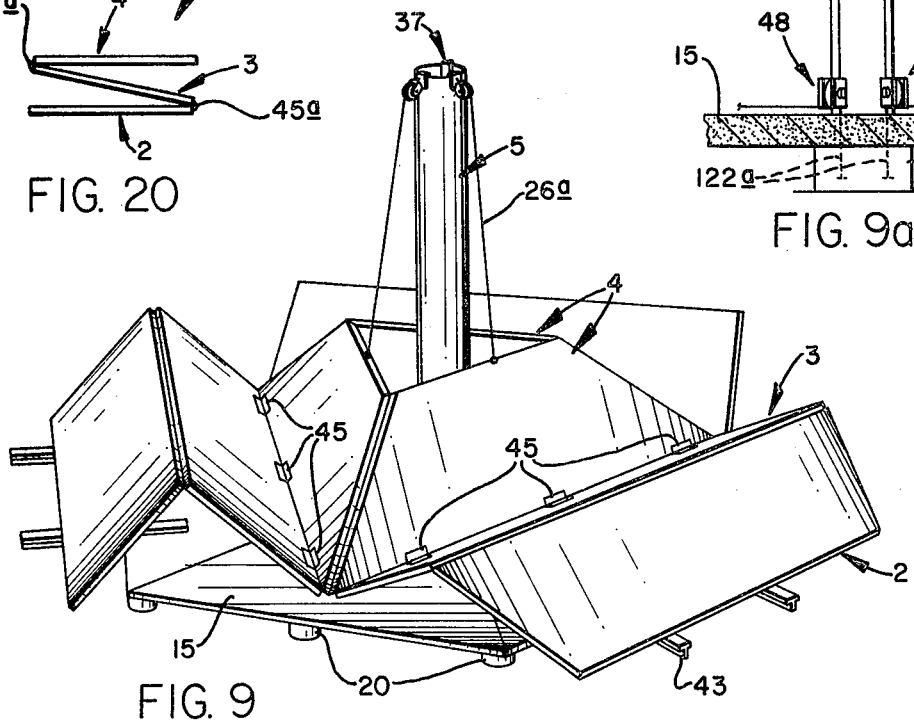
FIG. 9 is a view similar to FIG. 8, after the gin pole has been removed and a block and tackle system has been installed on the center support column.
Figure 10:
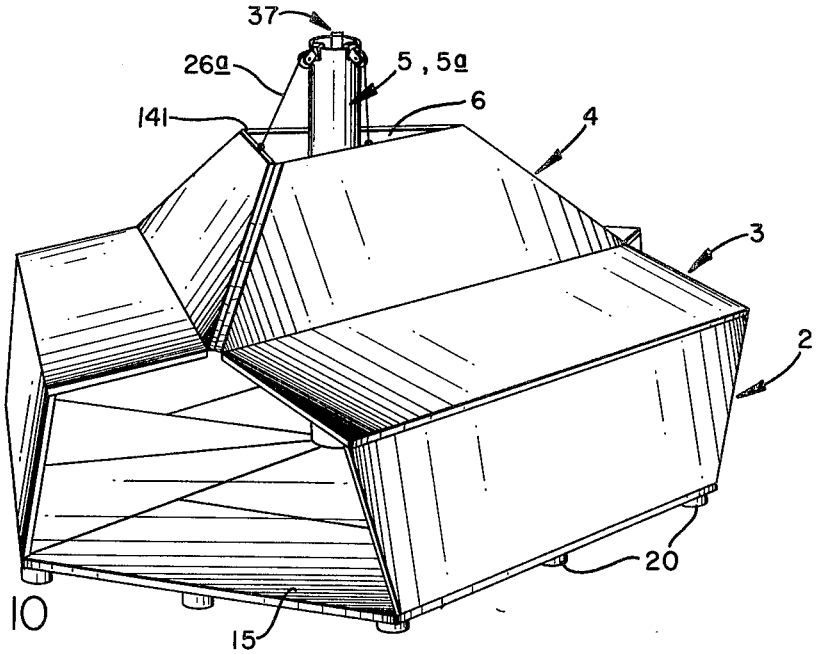
FIG. 10 is a view similar to FIG. 9, after the side walls and roof panels are in their final position and the outriggers have been removed.

5. (FIGS. 9 and 9*a*) Removing the gin pole boom 23. Attaching a snatch block 48 to floor 15 and receiving therein one cable from each of the three sets (FIG. 9*a*).

6. (FIG. 10) By means of the snatch block 48, pulling the cables therein and lifting the walls and roof sections. Removing the outrigger trusses and attaching the lower ends of wall sections 2 to the outer edge of the floor 15 by means of flashing brackets 76. Removing construction hinges 45 from the outer sides of panels 3 and 4. Removing all lift cable systems and installing short suspension chain or cable 42 between chimney 5 and topmost member 141. Attaching skylight system 50 comprising plexiglass 51 and braces 7 between chimney 5 and top portion of roof panels 4.

7. (FIG. 1) Installing entry overhang roof section 52 and window wall units 11 at each of three openings.

8. (FIG. 3*a*) Completing interior by installing partitions 53 and completing masonry "M" and other desired interior appointments, including the fireplace (not shown).

9. (FIGS. 2 and 19) Attaching porch 14 by hinges 54 to floor 15 and installing latch system 110 and 111 to top cross bar 17 and porch 14.

10. (FIG. 3*c*) Beams 68*a* are installed for lateral wind support for two alternatives (center support 5*a* or none).

In another embodiment, the completed building structure 1 is installed on a tripod truss structure 40 as shown in FIGS. 11*a* and 11*b* by substantially the same method as described above, but by attaching chimney 5 or temporary support tube 5*a* to center pod 121 by bolts 122*b*.

In FIGS. 12–12*e* the roof sections and details of connecting structures are shown.

FIG. 12*a* is a detail showing the roof connection shown at line A—A of FIG. 12. The two roof panels 4 are joined together at their apex by angle bracket 56 attached to each member 4 by lag bolts 57. The outer and inner plywood sheets 58 and 59 are spaced apart by wood rafters 60 having a two foot or similar spacing and filled with insulation "I" therebetween. Similar rafters 60*a* and *b* and insulation are used in sections 3 and 2 also. On top of the outer plywood 58 a thin layer of roofing 61 is installed, and over the roofing at the intersection of members 4, a length of flashing 62 is installed for the full length of the intersection. Wooden beams 63 overlap the rafters 60 and provide support for lag bolts 57.

FIG. 12*b* shows the method of joining roof sections 3 and 4 to be the use of a bent bracket plate 65 held to members 3 and 4 by lag bolts 57 engaging both the inner plywood panels 59 and beams 63. The outer plywood panels 58 and roofing 61 are the same as shown in FIG. 12*a*. The flashing 67 is of a different configuration but extends the full length of the intersection to protect against leakage thru the line of joinder between the roof panel sections 3 and 4. A decorative trim in the form of false boxed beam 68 is attached thru glued nailers 69 in a manner to straddle the bracket plate 65 and improve the inside appearance of the building of this invention.

FIG. 12*c* shows the joinder between lower roof sections 3 and side walls 2 to be accomplished thru angle brackets 65′ and lag bolts 57 which attach to panels 2 and 3 in the same manner as described relative to FIG. 12*b*, including the installation of false boxed beam 68*a* and nailers 72. This joint illustration also shows the outer and inner plywood panels 58 and 59 and the roofing 61, beams 63 and spacers 64 and the ornamental batten 9 which is optional in the construction, but in the instance shown covers the roof and side wall sections 3 and 2 with the exception of the area of the flashing 73. Battens 9 also optionally are used on upper roof sections 4.

FIG. 12*d* shows the engagement of the lower edge of side wall sections 2 and the foundation, in this embodiment being concrete slab 75, to include a uniquely shaped, heavy gage angle flashing 76 attached to side wall beam 63 and to the foundation 75 thru lag bolts 57. Both the outer plywood 58 and the roofing 61 extend beyond the end of side walls 2 so as to overlap the foundation 75 to stabilize and position the entire structure onto the foundation. The side walls 2 are thus attached to the foundation thru lag bolts 57 which engage moly sockets (not shown) in the concrete foundation. The moly sockets being sockets that expand to grip the concrete when engaged by a threaded bolt. Moly sockets are not used where the flashing 76 is attached directly to the flooring 15 by lag screws (not shown).

FIG. 12*e* shows the truss construction of the underside of the upper roof sections 4 to include vertical rafters or joists 60 connected at each end by beams 63 and then overlaid by bridging 81 to form an inverted king bridge truss which provides additional support for the attached support cable or chain 42.

The wood filler wedge blocks 70 run the full length of panels 2 and 3 and are nailed to the corresponding beam 63 to provide additional support for the structural loads at these junctures. The open area between beam 63 and foundation 75 may include a similar wedge block 70 attached to beam 63; in which case the heavy duty flashing 76 may comprise a right angle bracket with a countersunk socket (not shown) to receive the head of upper bolt 57 and permit the flashing 76 to conform to the corner of foundation 75.

Reference is made herein to the long continuous or "solid" wall sides of the polygon plan of one embodiment of the building structure of this invention. It is generally desired that the solid sides be longer than the window or door sides because of the better insulation properties of the side wall panels 2 over the large glass areas of the window wall sides. In the embodiment shown in FIG. 19, elongated roof panels **3*a* are employed above both window and door wall sections 100 (referred to generally as "window wall sections"), and wall panels 2**.

Figure 13:
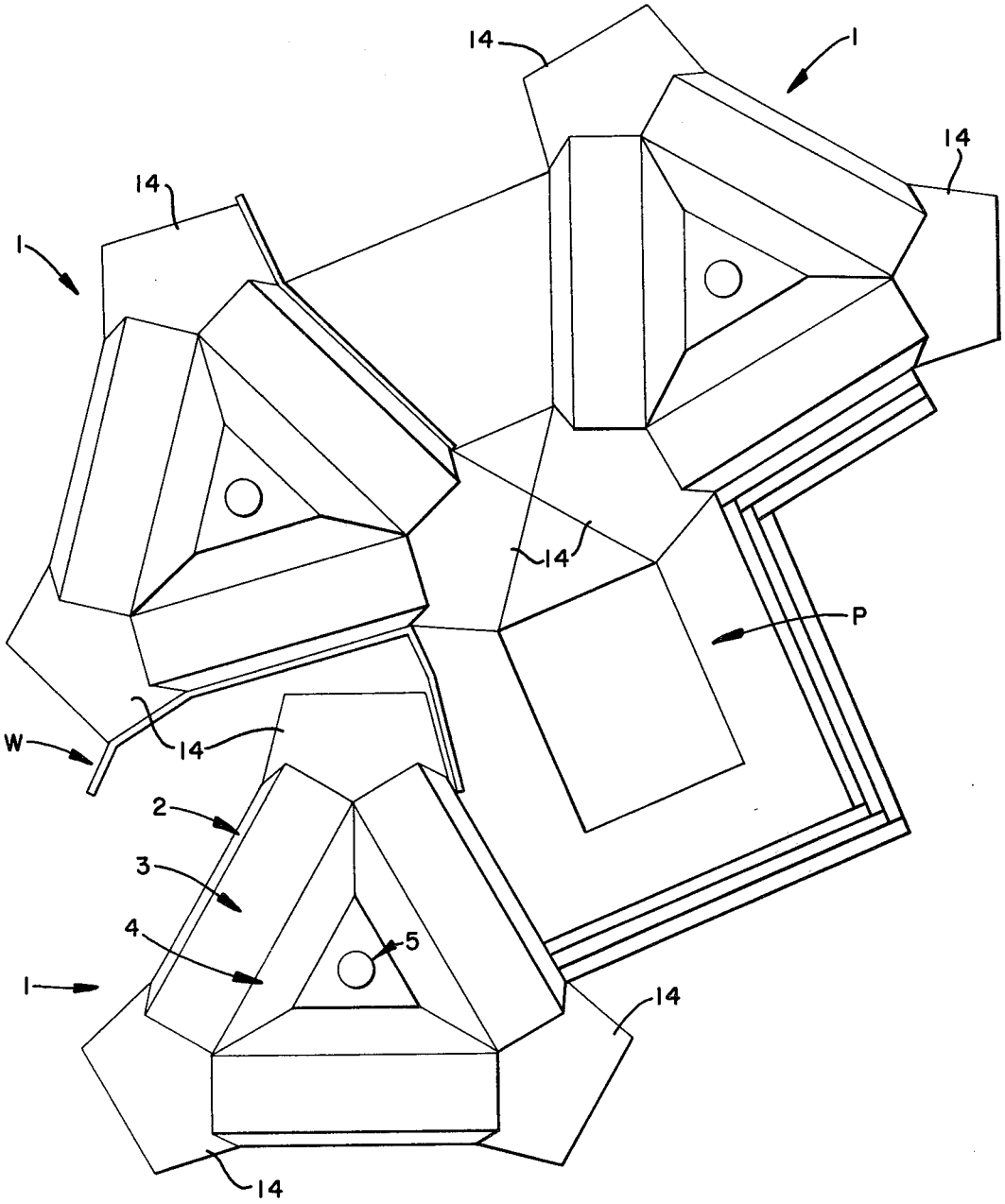
FIG. 13 is a plan lay-out showing several buildings of FIG. 1 arranged in a cluster about a common area.

FIG. 13 shows a cluster arrangement of three building structures assembled at the same building site for the purpose of providing a larger dwelling or for multiple dwellings connected together about a common patio or pool area "P". Many and varied arrangements of plans may be devised either on a single level or multiple levels of construction to provide single or multiple family residences, resort cabins, green houses, utility buildings, barns, factory buildings, commercial and industrial developments, and many other uses. Separating walls "W" may be arranged as desired to provide privacy to the individual units 1.

Figure 18:
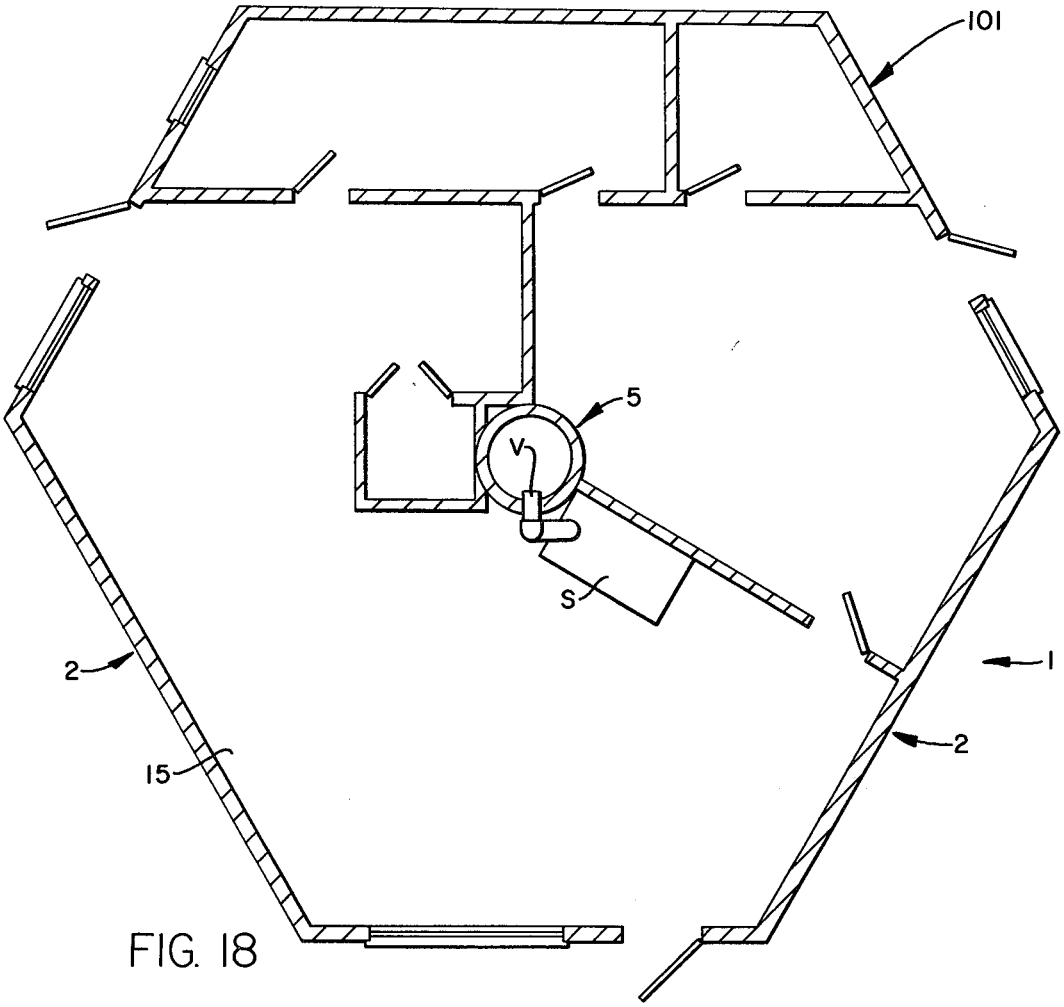
FIG. 18 is a plan view, partly in section, showing one embodiment of a floor plan with selected interior appointments when the building unit of this invention is used as a residence or resort house.

FIG. 18 shows an alternate floor plan 101 in a structure having a permanent central support tube and swinging outside doors. Alternatively, stove S may be vented into central chimney 5.

Figure 3B:
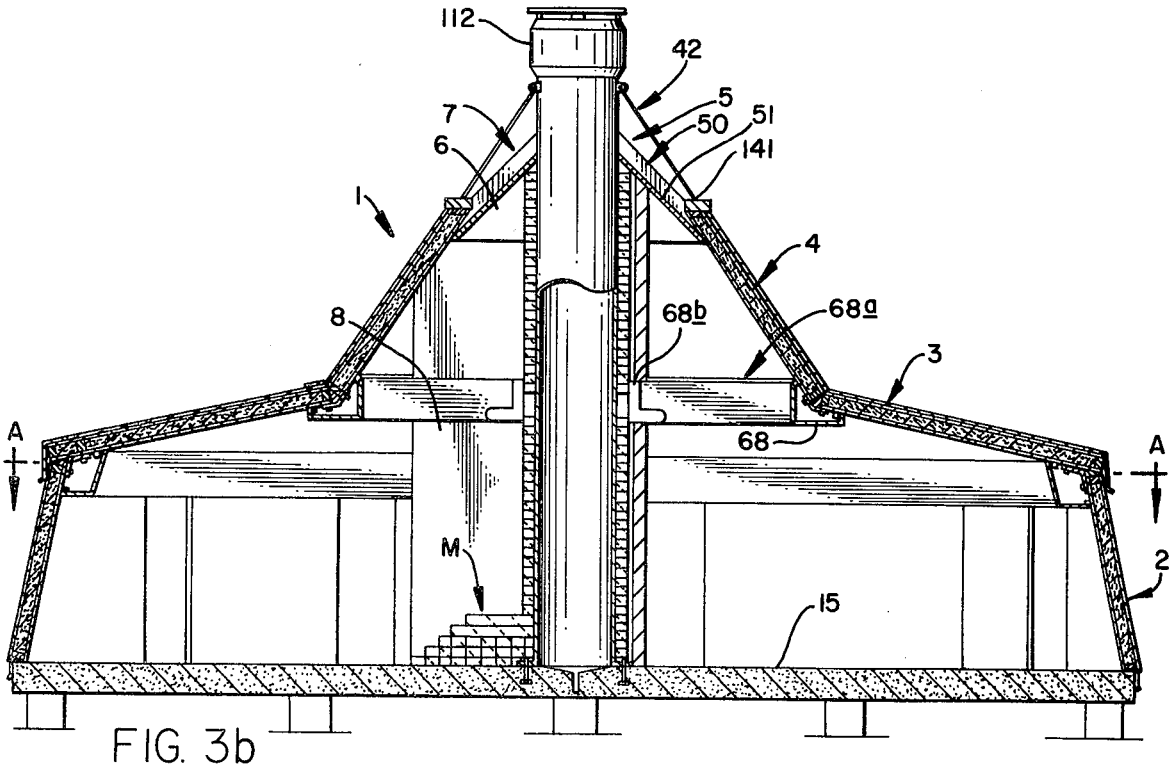
FIG. 3*b* is a cross-sectional elevational view taken along the lines B—B of FIG. 3*a;*

Supplementing the preceeding disclosures, it is seen that at least three basic structural concepts are involved in both the erection and configuration of the modular building(s) of this invention:

1. The chimney 5 is firmly and permanently anchored to the foundation 21, or mounting pad 121, and serves as a central support and focal point about which the erection operation takes place. Beams **68*a* are then attached to chimney 5 as shown in FIG. 3*b* to enhance the structural support, which is rounded out by attaching the structural bracing as shown in FIGS. 12–12*e***.

2. The central support tube **5*a* is firmly and temporarily anchored to the foundation 21 or 121, and serves in the same manner as chimney 5 above, except that it is usually removed after erection to permit the beams 68*a* to join in the building center as seen in FIGS. 3*c–e***.

3. The central support column or tube **5*a* may be left in place as shown dotted in FIG. 3*c* after erection, and will be equipped with topper hood 112** (to prevent rain in) even tho it will not function as a chimney, but as a permanent structural member.

In instance 2 above, the skylight system **50*a* (not shown) will enclose opening 6, but without provision for chimney 5 or tube 5*a*. This embodiment, with a horizontal roof section 3, would readily lend itself to the structural stacking shown in FIG. 2 of copending design application Ser. No. 737,892, filed Nov. 1, 1976, and incorporated herein by reference. Either embodiment would be practical in the clustered arrangement shown in FIG. 3** of this design application.

FIG. 17 shows a drain pipe "D" that may collect condensation, if any, or may dispose of rain water blown into chimney 5 or tube **5*a***.

FIG. **9*a* shows the use of three extra long bolts 122*a* to pivotally support the snatch (pulley) blocks 48 for one of the lifting operations. After this operation is completed, blocks 48 are removed and long bolts 122*a* are cut off to the same length as the remaining bolts 122 or 122*b***.

The methods and structures disclosed and illustrated herein are representative of but not limiting to the scope of the invention as defined in the following claims and including equivalents thereof.

What is claimed is:

1. A method of erecting a building structure having a foundation and centrally located chimney, comprising the steps of:

a. attaching a band around the lower part of said chimney,
b. pivotally attaching the lower end of a crane boom to said band,
c. operationally attaching said crane boom elsewhere to said chimney and to a floor panel,
d. working said crane boom to lift and install said floor panel into engagement with said foundation,
e. rotating said band and said crane boom around said chimney to selectively install successive floor panels adjacent previously installed floor panels until the floor is completed,
f. attaching outriggers to said completed floor,
g. using said crane boom to lift three rectangular lower roof and three trapazoidal upper roof panels onto said outriggers,
h. pivotally attaching the lower side of said trapazoidal panels to the upper long side of said rectangular panels,
i. using said crane boom to lift the trapazoidal side to an elevated position,
j. engaging each parallel side of each trapazoidal roof panel with the corresponding side of each adjacent roof panel,
k. installing a template under each lower roof panel to position a wall panel to properly engage each lower roof section,
l. attaching said wall panels to said lower roof sections,
m. removing said crane boom and its attaching members from said chimney,
n. installing a pulley support member and block and tackle means to the upper portion of said chimney,
o. using said block and tackle means to lift said wall and roof panels to their proper vertically oriented positions,
p. attaching each adjacent upper roof panel together and installing support means thereunder,
q. installing support means between said chimney and said upper roof panels,
r. removing said outriggers from said floor,
s. attaching said wall panels to said floor and all panels together,
t. installing a skylight between the top upper roof panels and said chimney,
u. installing window wall units between selected adjacent lower wall panels, and,
v. installing wall door units between the other adjacent lower wall panels to complete the building structure.

* * * * *